US008723406B2

(12) United States Patent
Kato

(10) Patent No.: US 8,723,406 B2
(45) Date of Patent: May 13, 2014

(54) SPARK PLUG

(75) Inventor: Tomoaki Kato, Aichi (JP)

(73) Assignee: NGK Spark Plug Co., Ltd. (JP)

( * ) Notice: Subject to any disclaimer, the term of this patent is extended or adjusted under 35 U.S.C. 154(b) by 0 days.

(21) Appl. No.: 13/395,902

(22) PCT Filed: Aug. 20, 2010

(86) PCT No.: PCT/JP2010/064059

§ 371 (c)(1),
(2), (4) Date: Mar. 14, 2012

(87) PCT Pub. No.: WO2011/033902

PCT Pub. Date: Mar. 24, 2011

(65) Prior Publication Data

US 2012/0169207 A1 Jul. 5, 2012

(30) Foreign Application Priority Data

Sep. 18, 2009 (JP) ..... 2009-216621

(51) Int. Cl.
*H01T 13/20* (2006.01)

(52) U.S. Cl.
USPC ..... 313/141

(58) Field of Classification Search
USPC ..... 313/118–145; 123/32, 41, 143 R, 123/146.5 R, 169 P, 260, 280, 169 R, 169 EL, 123/310
See application file for complete search history.

(56) References Cited

U.S. PATENT DOCUMENTS

| | | | | |
|---|---|---|---|---|
| 4,414,483 | A * | 11/1983 | Nishio et al. | 313/136 |
| 6,130,498 | A | 10/2000 | Shimizu et al. | 313/141 |
| 6,566,793 | B2 | 5/2003 | Honda et al. | 313/141 |
| 7,795,791 | B2 | 9/2010 | Joseph et al. | 313/141 |
| 2007/0222351 | A1 | 9/2007 | Nunome | 313/143 |

FOREIGN PATENT DOCUMENTS

| | | | |
|---|---|---|---|
| CN | 101517850 | 8/2009 | H01T 13/04 |
| EP | 0 341 807 | 11/1989 | H01T 13/04 |
| EP | 1 309 052 | 5/2003 | H01T 13/34 |
| JP | 4133282 | 5/1992 | H01T 13/00 |
| JP | 11-242979 | 9/1999 | H01T 13/20 |
| JP | 2001-155839 | 6/2001 | H01T 13/20 |
| JP | 2002013734 A * | 1/2002 | F23Q 7/00 |

OTHER PUBLICATIONS

Form PCT/ISA/210—Int'l Search Report (from corresponding Int'l Patent App. No. PCT/JP2010/064059—English version only); 1 page.

Office Action received in corresponding Chinese Patent Application No. 201080040132.7 on Dec. 18, 2013; English translation, 9 pages.

Extended European Search Report received in connection with corresponding European Patent Application No. 10817015.0, dated Mar. 19, 2014.

* cited by examiner

*Primary Examiner* — Donald Raleigh
(74) *Attorney, Agent, or Firm* — Kusner & Jaffe

(57) ABSTRACT

A spark plug includes a ceramic insulator having an axial bore extending in the direction of an axis (CL1) and a terminal electrode inserted into the axial bore. The terminal electrode includes a rodlike leg portion inserted into the a rear end portion of the axial bore and a head portion exposed at the rear end of the ceramic insulator. A front end subportion of the leg portion of the terminal electrode is fixed to the ceramic insulator, and the leg portion has a length of 35 mm or more along the axis (CL1). The center of gravity of the terminal electrode is located in the interior of the ceramic insulator.

5 Claims, 5 Drawing Sheets

SPARK PLUG

FIELD OF THE INVENTION

The present invention relates to a spark plug for use in an internal combustion engine or the like.

BACKGROUND OF THE INVENTION

A spark plug is used in an internal combustion engine or the like and typically includes an insulator having an axial bore extending in the axial direction. A center electrode is provided at the front end side of the axial bore, and a terminal electrode is provided at the rear end side of the axial bore. The terminal electrode includes a head portion which is exposed at the rear end of the insulator and to which a plug cap or the like is to be attached for supply of power. The terminal electrode further includes a rodlike leg portion which is inserted into the axial bore of the insulator and whose front end subportion is fixed to the insulator by means of a glass seal or the like. A cylindrical metallic shell is fixed to an outer circumference of the insulator. A ground electrode is joined to a front end portion of the metallic shell. A predetermined voltage is applied to the spark plug via the plug cap or the like attached to the terminal electrode, thereby generating spark discharges between the center electrode and the ground electrode.

In recent years, in view of environmental protection and the like, the fuel consumption of an internal combustion engine has been severely regulated. In order to prevent a drop in output while at the same time meeting the regulation of fuel consumption, a reduction in the displacement of the internal combustion engine, a higher degree of compression and/or a higher degree of supercharging has been employed.

An internal combustion engine which employs a higher degree of compression and/or a higher degree of supercharging requires a higher voltage for spark discharge. However, increasing an applied voltage may cause current to leak between the terminal electrode and the metallic shell in such a manner as to creep (i.e., migrate) onto the surface of the insulator, potentially resulting in the occurrence of misfire associated with discharge abnormality. In order to prevent the leakage of current (so-called flashover), increasing the length (to, for example, about 35 mm) of a portion (a rear trunk portion) of the insulator extending between the terminal electrode and the metallic shell was conceived (refer to, for example, Japanese Patent Application Laid-Open (kokai) No. 2001-155839). In this case, in association with an increase in the length of the rear trunk portion of the insulator, the leg portion of the terminal electrode to be inserted into the insulator increases in length.

SUMMARY OF THE INVENTION

As compared with a conventional engine, a high-efficiency engine or the like in which a special control system for performing, for example, variable valve timing control or cylinder stop control is incorporated, involves larger vibration associated with operation and larger acceleration imposed on the terminal electrode. Thus, when the leg portion of the terminal electrode is elongated as mentioned above, a very large stress is imposed on the leg portion as a result of the vibration. The vibration causes the head portion of the terminal electrode to oscillate with a front end subportion of the leg portion that is fixed to the insulator serving as a base point. Accordingly, the terminal electrode may break.

The present invention has been conceived in view of the above circumstances. An object of the present invention is to provide a spark plug whose terminal electrode has a relatively long leg portion and where breakage of the terminal electrode is more reliably prevented.

Configurations suitable for achieving the above objects will next be described in itemized form. If needed, actions and effects peculiar to the configurations will be described additionally.

Configuration 1: In accordance with a first embodiment of the present invention, there is provided a spark plug comprised of an insulator having an axial bore extending in a direction of an axis. A terminal electrode having a rodlike leg portion is inserted into a rear end portion of the axial bore and a head portion exposed at a rear end of the insulator. A front end subportion of the leg portion is fixed to the insulator. The leg portion has a length of 35 mm or more along the axis. The center of gravity of the terminal electrode is located inside the insulator.

A spark plug according to the above configuration 1 involves a great concern about breakage of the terminal electrode associated with vibration, since the leg portion of the terminal electrode has a length of 35 mm or more along the axis.

In this respect, according to the above configuration 1, the center of gravity of the terminal electrode is located in the interior (axial bore) of the insulator. A spark plug according to configuration 1 has a portion of the terminal electrode, where the center of gravity is located, held by the wall surface of the axial bore, and the distance along the axis from the front end of the leg portion to the position of the center of gravity is relatively short. Thus, when, in association with operation of an internal combustion engine or the like, the terminal electrode oscillates with a front end subportion of the leg portion serving as a base point, stress imposed on the leg portion can be greatly reduced. As a result, breakage of the terminal electrode can be more reliably prevented.

Furthermore, while breakage of the terminal electrode is prevented, the leg portion can have a length of 35 mm or more, and a portion of the insulator (a rear trunk portion) located between the metallic shell and the head portion of the terminal electrode can be rendered longer. As a result of this, even when a supply voltage to the spark plug (a voltage required by the spark plug) is increased, leakage of current from the terminal electrode to the metallic shell along the surface of the insulator (the rear trunk portion) can be more reliably prevented, whereby the occurrence of misfire associated with discharge abnormality can be more reliably restrained.

Additionally, since the entire terminal electrode is not disposed within the insulator, but the head portion of the terminal electrode is exposed at the rear end of the insulator, an electrical connection can be more reliably established between the head portion of the terminal electrode and a plug cap or the like for supply of power. Thus, voltage can be more reliably applied to the spark plug, whereby the occurrence of discharge abnormality can be more reliably restrained. The establishment of such a more reliable electrical connection between the terminal electrode and the plug cap or the like is preferred, for example, in situations where an ion current detection system is provided so as to judge the condition of ignition through application of a voltage (e.g., 300 V to 500 V), which is far lower than a voltage (e.g., about 30,000 V) applied for ignition, because the ion current detection system can be operated more stably.

Configuration 2: In accordance with a second embodiment of the present invention, there is provided a spark plug, as described above, wherein the terminal electrode has a Vickers hardness of 150 Hv or greater.

Configuration 2 specifies that the terminal electrode has a Vickers hardness of 150 Hv or greater. Because the terminal electrode has sufficiently high strength, resistance to breakage can be further improved.

Configuration 3: In accordance with a third embodiment of the present invention, there is provided a spark plug, as described above in the above configurations 1 or 2, wherein the center of gravity of the terminal electrode is located 5 mm or more frontward from the rear end of the insulator as measured along the axis.

According to the above configuration 3, the center of gravity of the terminal electrode is located 5 mm or more frontward from the rear end of the insulator as measured along the axis, whereby stress to be imposed on the leg portion in association with vibration can be further reduced. As a result, breakage of the terminal electrode can be more reliably prevented.

Configuration 4: In accordance with a fourth embodiment of the present invention, there is provided a spark plug, as described in any one of the above configurations 1 to 3, wherein the insulator has a rear trunk portion located at the rear end side of the insulator and having an outside diameter of 9 mm or less and that the head portion has a weight of 0.8 g or less.

As mentioned above, in order to supply power to the spark plug, a plug cap or the like for supply of power is attached to the head portion of the terminal electrode. When vibration is imposed on the terminal electrode in this condition, stress is imposed on the leg portion of the terminal electrode with the head portion of the terminal electrode held by the plug cap or the like serving as a base point. Thus, the leg portion may impact the inner circumferential surface of the insulator. If the insulator has a sufficiently large wall thickness, the occurrence of fracture of the insulator is believed to be less likely. However, in recent years, in order to meet a demand for a reduction in spark plug size, an insulator has been reduced in diameter and wall thickness. Such an insulator involves the risk of fracture caused by the impact of the leg portion.

In this respect, the insulator of the above configuration 4 is reduced in diameter such that the rear trunk portion thereof has an outside diameter of 9 mm or less. Thus, the insulator involves a greater concern about fracture. However, the present configuration 4 specifies the weight of the head portion of the terminal electrode as 0.8 g or less. I In view of correlation between stress imposed by the leg portion on the insulator and the weight of the head portion of the terminal electrode disposed externally of the insulator, by means of the weight of the head portion being reduced to a sufficiently small value of 0.8 g or less, the impact of the leg portion on the insulator is reduced. Thus, even though the insulator is reduced in diameter, fracture of the insulator can be more reliably prevented.

Configuration 5: In accordance with a fifth embodiment of the present invention, there is provided a spark plug, as described in any one of the above configurations 1 to 4, wherein the insulator has a rear trunk portion that is located at the rear end side of the insulator and that has an outside diameter of 9 mm or less, and wherein the head portion of the terminal electrode has a length of 5 mm or less along the axis.

In view of correlation between stress imposed by the leg portion on the insulator and the length of the head portion of the terminal electrode disposed externally of the insulator, the above configuration 5 specifies the length of the head portion along the axis as a relatively short length of 5 mm or less. Therefore, impact of the leg portion on the insulator can be reduced. Thus, even when the insulator is reduced in outside diameter to 9 mm or less, fracture associated with vibration can be more reliably prevented.

Configuration 6: In accordance with a sixth embodiment of the present invention, there is provided a spark plug, as described above in any one of the above configurations 1 to 5, wherein the head portion of the terminal electrode has a protrusion extending rearward with respect to the direction of the axis.

According to a conceivable method of electrically connecting together the head portion of the terminal electrode and the plug cap or the like, a coil spring connected to a conductor wire for power supply is provided within the plug cap, and an end portion of the coil spring is pressed against the head portion of the terminal electrode. Generally, the rear end surface of the head portion is formed flat. Thus, upon subjection to vibration, friction arises between the end portion of the coil spring and the head portion. As a result, metal powder may be generated through wear. When the metal powder adheres to the surface of the rear trunk portion of the insulator, current is apt to leak from the head portion to the metallic shell, potentially resulting in the occurrence of discharge abnormality.

In this connection, according to the above configuration 6, the head portion of the terminal electrode has a protrusion. Through insertion of the protrusion into an end portion of the coil spring, movement of the coil spring relative to the head portion can be restrained. As a result, the generation of metal powder through wear can be more reliably prevented, and in turn, the generation of discharge abnormality can be effectively restrained.

DETAILED DESCRIPTION OF PREFERRED EMBODIMENTS

Figure 1:
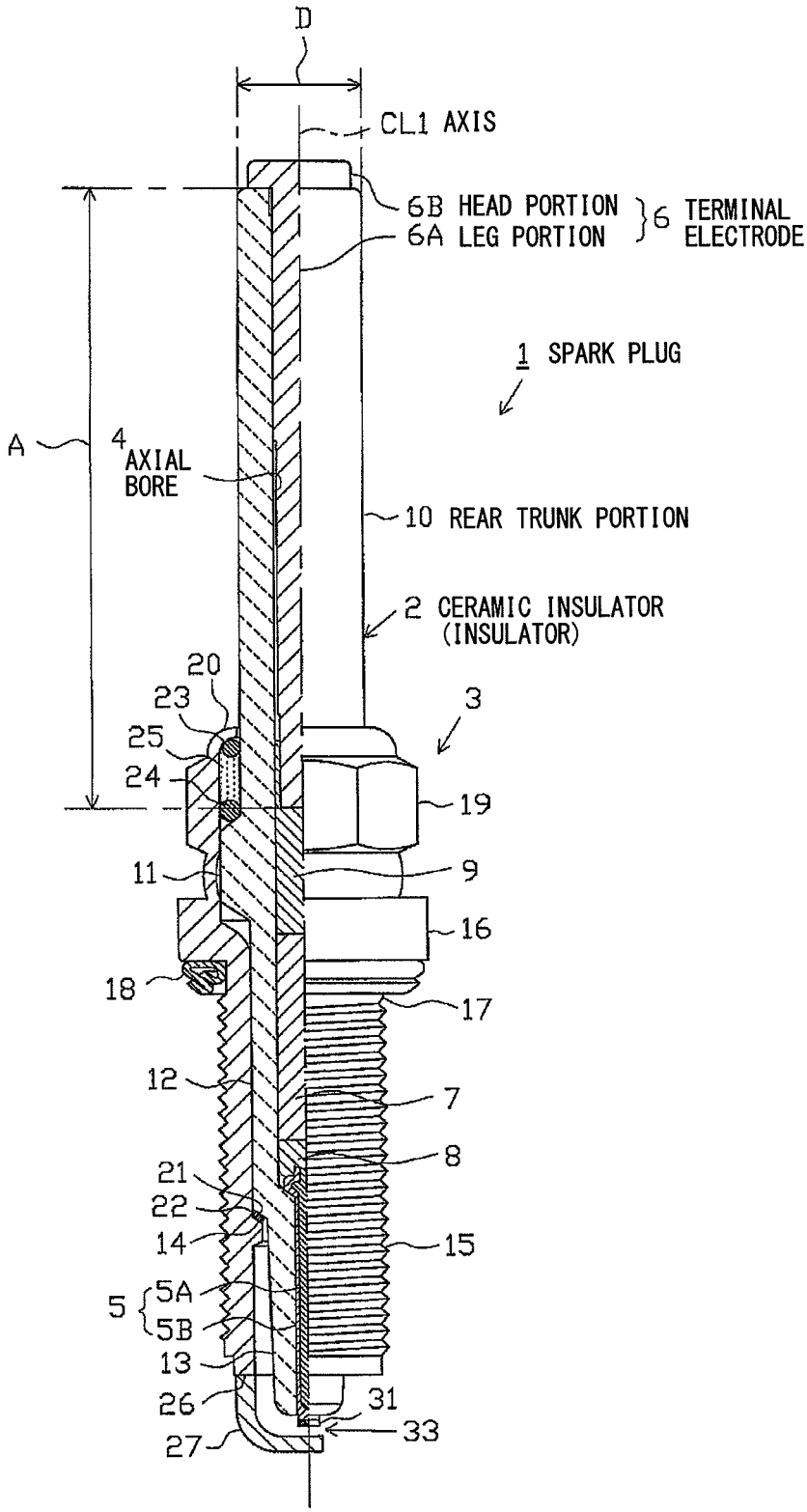
FIG. 1 is a partially cutaway front view showing the configuration of a spark plug.

An embodiment of the present invention will next be described with reference to the drawings. FIG. 1 is a partially cutaway front view showing a spark plug 1. In FIG. 1, the direction of an axis CL1 of the spark plug 1 is referred to as the vertical direction. In the following description, the lower side of the spark plug 1 in FIG. 1 is referred to as the front end side of the spark plug 1, and the upper side as the rear end side.

The spark plug 1 includes a tubular ceramic insulator 2 and a tubular metallic shell 3, which holds the ceramic insulator 2 therein.

The ceramic insulator 2 is formed from alumina or the like by firing, as well known in the art. The ceramic insulator 2, as viewed externally, includes a rear trunk portion 10 formed on the rear end side. A large-diameter portion 11 is located frontward of the rear trunk portion 10 and projects radially outward. An intermediate trunk portion 12 is located frontward of the large-diameter portion 11 and is smaller in diameter than the large-diameter portion 11. A leg portion 13 is located frontward of the intermediate trunk portion 12 and is smaller in diameter than the intermediate trunk portion 12. The large-diameter portion 11, the intermediate trunk portion 12, and most of the leg portion 13 of the ceramic insulator 2 are accommodated within the metallic shell 3. A tapered, stepped portion 14 is formed at a connection portion between the intermediate trunk portion 12 and the leg portion 13. The ceramic insulator 2 is seated on the metallic shell 3 at the stepped portion 14.

The ceramic insulator 2 has an axial bore 4 extending therethrough along the axis CL1. A center electrode 5 is fixedly inserted into a front end portion of the axial bore 4. The center electrode 5 assumes a rodlike (circular columnar) shape as a whole and projects from the front end of the ceramic insulator 2. The center electrode 5 includes an inner layer 5A made of copper or a copper alloy, and an outer layer 5B made of a Ni alloy which contains nickel (Ni) as a main component. A circular columnar noble metal tip 31, formed from a noble metal alloy (e.g., an iridium alloy or a platinum alloy), is joined to a front end portion of the center electrode 5.

A terminal electrode 6 is fixedly inserted into a rear end portion of the axial bore 4. The terminal electrode 6 includes a rodlike leg portion 6A extending along the axis CL1, and a head portion 6B located rearward of the leg portion 6A and having a diameter greater than that of the leg portion 6A. When the leg portion 6A is inserted into the axial bore 4, the head portion 6B is exposed at the rear end of the ceramic insulator 2. In order to allow easy insertion of the leg portion 6A into the axial bore 4, the outside diameter of the leg portion 6A is dimensioned so as to form a predetermined clearance between the leg portion 6A and the wall surface of the axial bore 4. A front end subportion of the leg portion 6A is fixed to the ceramic insulator 2 by means of a glass seal layer 9, which will be described below, whereby the terminal electrode 6 and the ceramic insulator 2 are fixed together.

A circular columnar resistor 7 is disposed within the axial bore 4 between the center electrode 5 and the terminal electrode 6. Opposite end portions of the resistor 7 are electrically connected to the center electrode 5 and the terminal electrode 6 via electrically conductive glass seal layers 8 and 9, respectively.

The metallic shell 3 is formed into a tubular shape from a low-carbon steel or a like metal. The metallic shell 3 has, on its outer circumferential surface, a threaded portion (externally threaded portion) 15 adapted to mount the spark plug 1 to a combustion apparatus, such as an internal combustion engine or a fuel cell reformer. The metallic shell 3 also has, on its outer circumferential surface, a seat portion 16 located rearward of the threaded portion 15. A ring-like gasket 18 is fitted to a screw neck 17 at the rear end of the threaded portion 15. The metallic shell 3 has, near the rear end thereof, a tool engagement portion 19 having a hexagonal cross section, dimensioned to allow a tool, such as a wrench, to be engaged therewith when the spark plug 1 is to be mounted to the combustion apparatus. The metallic shell 3 has a crimp portion 20 provided at a rear end portion thereof for retaining the ceramic insulator 2. In the present embodiment, the threaded portion 15 has a relatively small thread diameter of M12 or less.

The metallic shell 3 has, on its inner circumferential surface, a tapered, stepped portion 21 adapted to allow the ceramic insulator 2 to be seated thereon. The ceramic insulator 2 is inserted into the metallic shell 3 from the rear end of the metallic shell 3. In a state in which the stepped portion 14 of the ceramic insulator 2 butts against the stepped portion 21 of the metallic shell 3, a rear-end opening portion of the metallic shell 3 is crimped radially inward; i.e., the crimp portion 20 is formed, whereby the ceramic insulator 2 is fixed in place. An annular sheet packing 22 is disposed between the stepped portions 14 and 21 of the ceramic insulator 2 and the metallic shell 3, respectively. This arrangement retains gastightness of a combustion chamber and prevents outward leakage of fuel gas in a space between the inner circumferential surface of the metallic shell 3 and the leg portion 13 of the ceramic insulator 2, the leg portion 13 being exposed to the combustion chamber.

In order to ensure gastightness which is established by crimping, annular ring members 23 and 24 are disposed between the metallic shell 3 and the ceramic insulator 2 in a region near the rear end of the metallic shell 3, and a space between the ring members 23 and 24 is filled with powder of talc 25. In this respect, the metallic shell 3 holds the ceramic insulator 2 via the sheet packing 22, the ring members 23 and 24, and the talc 25.

A ground electrode 27 is joined to a front end portion 26 of the metallic shell 3. The ground electrode 27 is configured as follows: an intermediate portion thereof is bent such that a side surface of a distal end portion of the ground electrode 27 faces a front end portion of the center electrode 5. The ground electrode 27 is formed from an Ni alloy. Spark discharge is performed, substantially along the axis CL1, across a spark discharge gap 33 between the distal end portion of the ground electrode 27 and the front end portion (the noble metal tip 31) of the center electrode 5.

In the present embodiment, the rear trunk portion 10 of the insulator 2 has a relatively long length (e.g., 30 mm or more) along the axis CL1. Accordingly, the leg portion 6B of the terminal electrode 6 has a relatively long length A of 35 mm or more along the axis CL1.

The head portion 6B of the terminal electrode 6 is reduced in size, and the center of gravity of the terminal electrode 6 is located in the interior (the axial bore 4) of the ceramic insulator 2. In the present embodiment, the center of gravity of the terminal electrode 6 is located 5 mm or more frontward from the rear end of the ceramic insulator 2 as measured along the axis CL1.

The terminal electrode 6 is formed from an electrically conductive high-hardness alloy (e.g., chromium-molybdenum steel). Thus, the terminal electrode 6 has a Vickers hardness of 150 Hv or greater. The hardness of the terminal electrode 6 can be obtained as follows. The terminal electrode 6 is sectioned along a plane which contains the axis CL1. The sectional surface of the terminal electrode 6 is measured for hardness at five equally spaced points arranged on the axis CL1 between the head portion 6B and the front end of the leg portion 6A. The average of hardnesses measured at the five points is calculated, thereby obtaining the hardness of the terminal electrode 6. The hardness can be measured by use of the hardness meter AAV-501, a product of Mitutoyo Corp, and a diamond indenter in the form of a square pyramid. In measurement with the above-mentioned hardness meter, a test force (e.g., 980 mN) may be determined automatically.

The head portion 6B is reduced in size such that the weight is 0.8 g or less. Additionally, the length of the head portion 6B along the axis CL1 is 5 mm or less. In the spark plug 1 of the present embodiment, a length along the axis CL1 from the rear end of the metallic shell 3 to the rear end of the terminal electrode 6 is substantially equivalent to that of a conventional spark plug whose overall length along the axis CL1 is equivalent to that of the spark plug 1. However, since the spark plug 1 of the present embodiment is configured such that the length of the head portion 6B is relatively short (5 mm or less), as compared with the conventional spark plug having an equivalent overall length along the axis CL1, the rear trunk portion 10 has a longer length.

Furthermore, in association with a reduction in the thread diameter of the threaded portion 15, the ceramic insulator 2 is reduced in diameter. In the present embodiment, the rear trunk portion 10 has an outside diameter D of 9 mm or less and thus has a relatively thin wall thickness.

Figure 2:
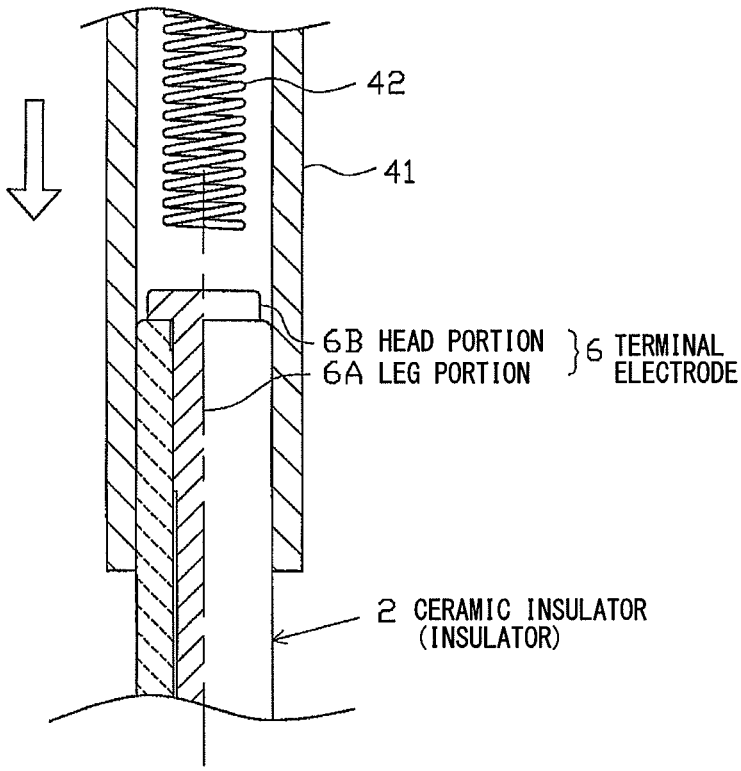
FIG. 2 is a partially cutaway, enlarged front view showing attachment of a plug cap to a terminal electrode.

In the present embodiment, the rear end surface of the head portion 6B of the terminal electrode 6 is formed flat. As shown in FIG. 2, when a plug cap 41 for power supply is attached to the terminal electrode 6, a front end portion of a coil spring 42, which serves as an electrically conductive path, comes into contact with the rear end surface of the head portion 6B.

Next, a method of manufacturing the spark plug 1 configured as mentioned above is described.

First, the metallic shell 3 is formed beforehand. Specifically, a circular columnar metal material (e.g., an iron-based material, such as S17C or S25C, or a stainless steel material) is subjected to cold forging for forming a through hole, thereby forming a rough shape. Subsequently, machining is performed so as to adjust the outer shape, thereby yielding a metallic-shell intermediate.

Subsequently, the ground electrode 27, having the form of a straight rod, is resistance-welded to the front end surface of the metallic-shell intermediate. The resistance welding is accompanied by formation of so-called "slags." After the "slags" are removed, the threaded portion 15 is formed in a predetermined region of the metallic-shell intermediate by rolling. Thus is yielded the metallic shell 3 to which the ground electrode 27 is welded. The metallic shell 3 to which the ground electrode 27 is welded is subjected to zinc plating or nickel plating. In order to enhance corrosion resistance, the plated surface may be further subjected to chromate treatment.

Separately from preparation of the metallic shell 3, the ceramic insulator 2 is formed. By way of example and not limitation, a forming material of granular substance is prepared by use of a material powder which contains alumina in a predominant amount, a binder, etc. By use of the prepared forming material of granular substance, a tubular green compact is formed by rubber press forming. The thus-formed green compact is subjected to grinding for shaping. The shaped green compact is subjected to firing, thereby yielding the ceramic insulator 2.

Separately from preparation of the metallic shell 3 and the ceramic insulator 2, the center electrode 5 is formed. Specifically, an Ni alloy, prepared such that a copper alloy or the like is disposed in a central portion thereof for enhancing heat radiation, is subjected to forging, thereby forming the center electrode 5. Next, the noble metal tip 31 is joined to a front end portion of the center electrode 5 by laser welding.

A rodlike member made of a high-hardness alloy, such as chromium-molybdenum steel, is subjected to forging and machining, thereby yielding the terminal electrode 6 having the leg portion 6A and the head portion 6B.

Then, the ceramic insulator 2 and the center electrode 5, which are formed as mentioned above, the resistor 7, and the terminal electrode 6 are fixed in a sealed condition by means of the glass seal layers 8 and 9. In order to form the glass seal layers 8 and 9, generally, a mixture of borosilicate glass and metal powder is prepared, and the prepared mixture is charged into the axial bore 4 of the ceramic insulator 2 such that the resistor 7 is sandwiched therebetween. Subsequently, the resultant assembly is heated in a kiln in a condition in which the charged mixture is pressed from the rear by the terminal electrode 6, thereby being fired and fixed. At this time, a glaze layer may be simultaneously fired on the surface of the rear trunk portion 10 of the ceramic insulator 2. Alternatively, the glaze layer may be formed beforehand. Exposure to heat within the kiln causes a slight reduction in hardness of the terminal electrode 6. However, even after the exposure to heat, the terminal electrode 6 has a Vickers hardness of 150 Hv or greater.

Subsequently, the thus-formed ceramic insulator 2 having the center electrode 5 and the terminal electrode 6, and the thus-formed metallic shell 3 having the ground electrode 27 are assembled together. More specifically, a relatively thin-walled rear-end opening portion of the metallic shell 3 is crimped radially inward; i.e., the crimp portion 20 is formed, thereby fixing the ceramic insulator 2 and the metallic shell 3 together.

Finally, a substantially intermediate portion of the ground electrode 27 is bent, thereby adjusting the magnitude of the spark discharge gap 33. The spark plug 1 is thus yielded.

As described in detail above, according to the present embodiment, the center of gravity of the terminal electrode 6 is located in the interior (the axial bore 4) of the ceramic insulator 2, a portion of the terminal electrode 6 where the center of gravity exists is held by the wall surface of the axial bore 4, and the distance along the axis CL1 from the front end of the leg portion 6A to the position of the center of gravity is rendered relatively short. Thus, when, in association with operation of an internal combustion engine or the like, the terminal electrode 6 oscillates with a front end subportion of the leg portion 6A serving as a base point, stress imposed on the leg portion 6A can be greatly reduced. As a result, breakage of the terminal electrode 6 can be more reliably prevented.

Furthermore, while breakage of the terminal electrode 6 is prevented, because the leg portion 6A can have a length A of 35 mm or more, the rear trunk portion 10 of the ceramic insulator 2 can be rendered longer. By virtue of this, even when a supply voltage to the spark plug 1 is increased, leakage of current from the terminal electrode 6 to the metallic shell 2 along the surface of the ceramic insulator 2 (the rear trunk portion 10) can be more reliably prevented, whereby the occurrence of misfire associated with discharge abnormality can be more reliably restrained.

Additionally, since the head portion 6B of the terminal electrode 6 is exposed at the rear end of the ceramic insulator 2, an electrical connection can be more reliably established between the head portion 6B and the plug cap 41 for supply of power. Thus, voltage can be more reliably applied to the spark plug 1, whereby the occurrence of discharge abnormality can be more reliably restrained.

Further, since the terminal electrode 6 has sufficiently high strength; i.e., a Vickers hardness of 150 Hv or greater, resistance to breakage can be further improved.

Also, according to the present embodiment, since the weight of the head portion 6B of the terminal electrode 6 is 0.8 g or less, the vibration-induced impact of the leg portion 6A on the insulator 2 can be reduced. Thus, even though the ceramic insulator 2 is reduced in diameter such that the outside diameter D of the rear trunk portion 10 is 9 mm or less, fracture of the ceramic insulator 2 can be more reliably prevented.

Additionally, since the length of the head portion 6B along the axis CL1 is shortened to 5 mm or less, fracture of the ceramic insulator 2 associated with vibration can be more reliably prevented.

As mentioned above, even though the rear trunk portion 10 is relatively long, the spark plug 1 of the present embodiment is substantially equivalent in length along the axis CL1 from the rear end of the metallic shell 3 to the rear end of the terminal electrode 6 to a conventional spark plug whose overall length along the axis CL1 is equivalent to that of the spark plug 1. Therefore, a conventionally used plug cap or the like can be used as it is.

Figure 3:
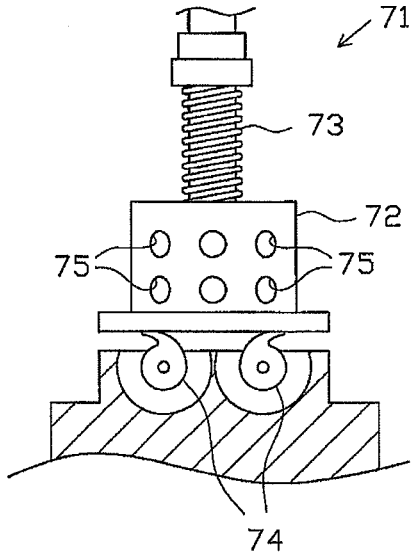
FIG. 3 is a partially cutaway front view showing the schematic configuration of a test machine for use in an impact resistance test.

Next, in order to confirm an action and effects yielded by the above embodiment, a plurality of spark plug samples whose terminal electrodes had a hardness of 120 Hv or 150 Hv and which differed in the size of the head portion so as to differ in the position of the center of gravity were fabricated. The samples were subjected to an impact resistance test. The outline of the impact resistance test is as follows. First, a test machine 71 was prepared. As shown in FIG. 3 (a schematic view), the test machine 71 includes a bushing 72, which has a closed-bottomed cylindrical shape and a plurality of internally threaded portions 75 for mounting plugs and is supported in a vertically movable manner. A spring 73 is provided for applying force downward to the bushing 72 from above. A plurality of cams 74 are provided in contact with the bottom surface of the bushing 72. By means of rotating the cams 74, the bushing 72 is moved vertically. The samples were mounted to the respective internally threaded portions 75 of the bushing 72. The bushing 72 was moved vertically in such a condition that a maximum acceleration of 4,000 G was applied to the terminal electrodes of the samples. Time until the terminal electrodes broke (breakage time) was measured.

Figure 4:
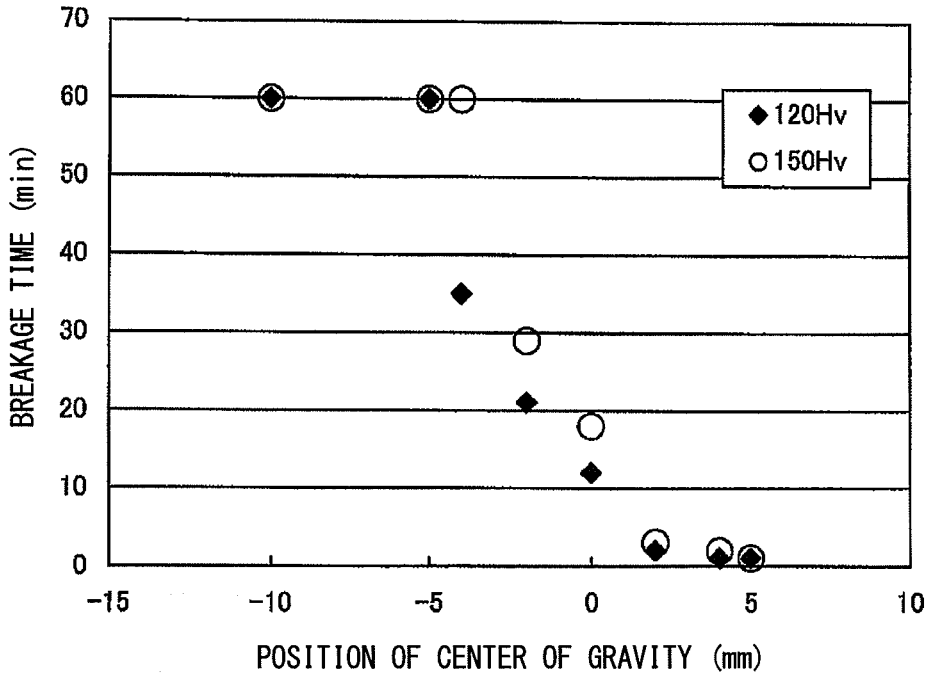
FIG. 4 is a graph showing the results of the impact resistance test conducted on samples which differ in hardness of the terminal electrode, etc.

FIG. 4 is a graph showing the relation between breakage time and the position of the center of gravity of the terminal electrode. In FIG. 4, the test results of the samples whose terminal electrodes have a hardness of 120 Hv are plotted with black diamonds, and the test results of the samples whose terminal electrodes have a hardness of 150 Hv are plotted with outlined circles. Furthermore, in the samples, the leg portions of the terminal electrodes had a length of 45 mm, and the rear trunk portions of the insulators had an outside diameter of 10.5 mm. Also, through formation from carbon steel, a hardness of 120 Hv was imparted to the terminal electrodes, and, through formation from chromium-molybdenum steel, a hardness of 150 Hv was imparted to the terminal electrodes. The test time was up to 60 minutes. For the samples whose terminal electrodes were free from breakage after the elapse of 60 minutes, they are shown in FIG. 4 to have a breakage time of 60 minutes. The position of the center of gravity of the terminal electrode is taken as positive when located rearward, along the axis, of the rear end of the insulator and is taken as negative when located frontward, along the axis, of the rear end of the insulator. For example, when the center of gravity of the terminal electrode is located 5 mm frontward, along the axis, of the rear end of the insulator, the position of the center of gravity is "−5 mm."

As is apparent from FIG. 4, the samples having a position of the center of gravity of greater than 0 mm; i.e., the samples in which the center of gravity of the terminal electrode is located externally of the insulator, suffer breakage of the terminal electrode after the elapse of less than 10 minutes from the start of the test, regardless of the hardness of the terminal electrode. Conceivably, this is for the following reason: since a portion of the terminal electrode where the center of gravity exists (head portion) is not supported by the insulator, vibration of the head portion of the terminal electrode causes a very large stress to be imposed on the leg portion.

By contrast, the samples having a position of the center of gravity of 0 mm or less; i.e., the samples in which the center of gravity of the terminal electrode is located in the interior of the insulator, are free from breakage of the terminal electrode at a point of time when 10 minutes have elapsed from the start of the test. Conceivably, this is for the following reason: since a portion of the terminal electrode where the center of gravity exists is held by the insulator, and the position of the center of gravity of the terminal electrode is located relatively close to the front end of the leg portion, stress to be imposed on the leg portion in association with vibration can be effectively reduced.

Particularly, the following has been revealed: as compared with the samples whose terminal electrodes have a hardness of 120 Hv, the samples whose terminal electrodes have a hardness of 150 Hv are longer in time until breakage occurs, indicating that the samples have quite excellent resistance to breakage.

Furthermore, the following has been confirmed: in spite of the terminal electrodes having a hardness of 120 Hv, the samples having a position of the center of gravity of −5 mm or less (less meaning −10 mm or 15 mm) are free from breakage of the terminal electrodes even after they have been subjected continuously to vibration for 60 minutes.

In view of the above test results, in order to prevent breakage of the terminal electrode associated with vibration, preferably, the center of gravity of the terminal electrode is located in the interior of the ceramic insulator. Also, in view of more reliable prevention of breakage of the terminal electrode, more preferably, the terminal electrode has a hardness of 150 Hv or greater, and the center of gravity of the terminal electrode is located 5 mm or more frontward, along the axis, from the rear end of the insulator.

Figure 5:
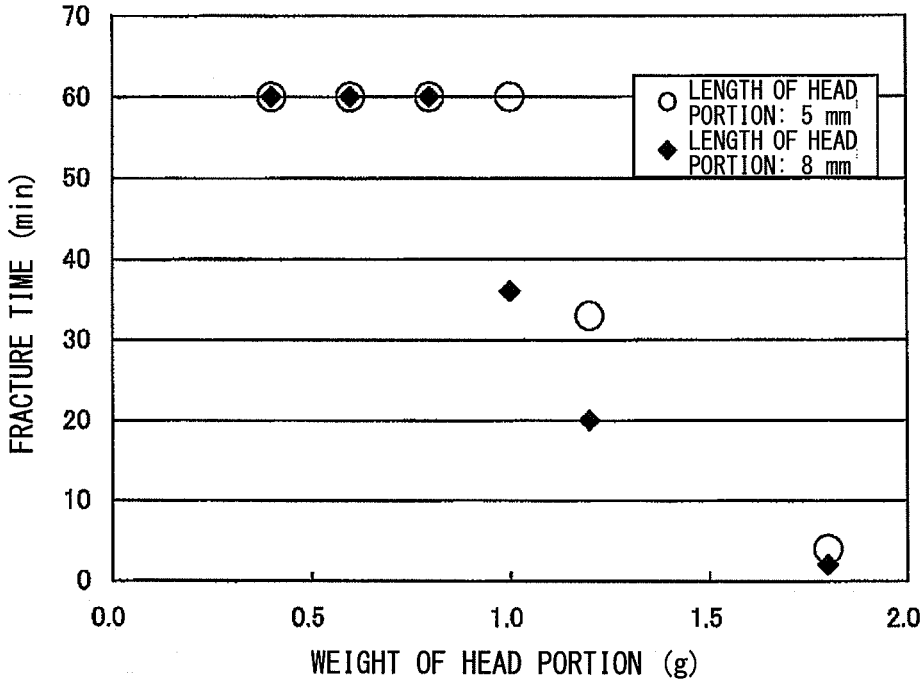
FIG. 5 is a graph showing the results of the impact resistance test conducted on samples which differ in length of a head portion of the terminal electrode, etc.

Next, there were fabricated a plurality of spark plug samples whose head portions of terminal electrodes had a length of 5 mm or 8 mm along the axis and differed in weight. The samples were subjected to the above-mentioned impact resistance test, and time until the insulators fractured (fracture time) was measured. FIG. 5 shows the results of the impact resistance test conducted on the samples. In FIG. 5, the test results of the samples whose head portions have a length of 5 mm are plotted with outlined circles, and the test results of the samples whose head portions have a length of 8 mm are plotted with black diamonds. In the samples, the rear trunk portions of the ceramic insulators had an outside diameter of 9 mm; the leg portions of the terminal electrodes had a length of 45 mm; and the terminal electrodes had a hardness of 150 Hv. Also, the position of the center of gravity of the terminal electrode was −5 mm or less. Furthermore, the test time was 60 minutes. For the samples whose insulators were free from fracture after the elapse of 60 minutes, they are shown in FIG. 5 to have a breakage time of 60 minutes.

As shown in FIG. 5, as compared with the samples whose head portions have a length of 8 mm, the samples whose head portions have a length of 5 mm exhibit a longer fracture time; in other words, the ceramic insulators are unlikely to fracture. Conceivably, this is for the following reason: since the length of the head portion is rendered relatively short, force applied from the leg portion of the terminal electrode to the ceramic insulator in association with vibration can be reduced.

Also, the following has been revealed: regardless of the length of the head portion, the samples whose head portions have a weight of 0.8 g are free from fracture of the insulators at a point of time when 60 minutes have elapsed from the start of the test.

In view of the above test results, in order to prevent fracture of the ceramic insulator associated with vibration, preferably, the head portion has a length of 5 mm or less along the axis. Also, in view of more reliable prevention of fracture of the insulator, more preferably, the head portion has a weight of 0.8 g or less.

The present invention is not limited to the above-described embodiment, but may be embodied, for example, as follows. Of course, applications and modifications other than those exemplified below are also possible.

Figure 6:
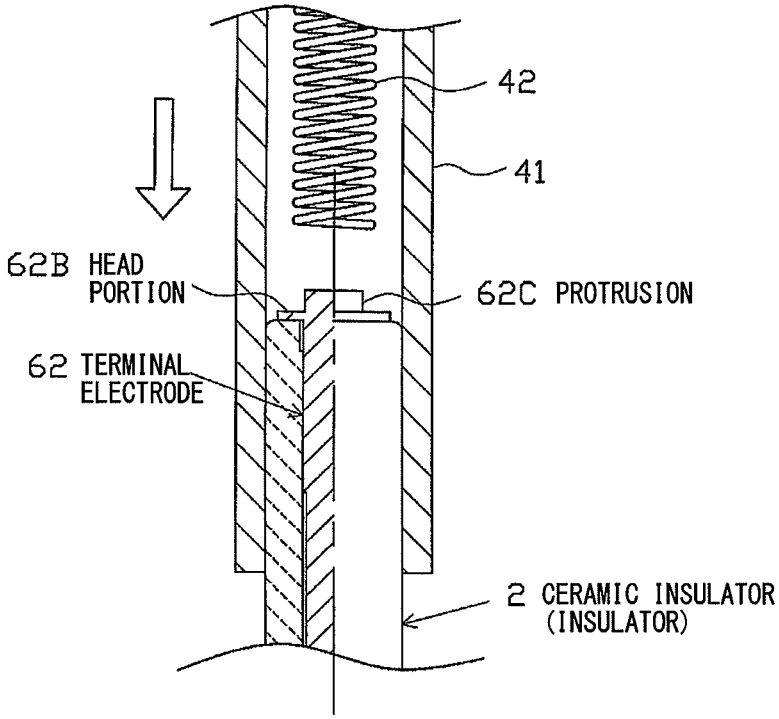
FIG. 6 is a partially cutaway, enlarged front view showing the head portion of the terminal electrode in another embodiment of the present invention.

(a) In the above embodiment, the rear end surface of the head portion 6B of the terminal electrode 6 is formed flat. However, as shown in FIG. 6, a head portion 62B may have a protrusion 62C extending rearward in the direction of the axis CL1 for allowing the protrusion 62C to be inserted into a front end portion of the coil spring 42. In this case, movement of the coil spring 42 relative to the head portion 62B can be prevented, whereby the generation of metal powder through wear or a like problem can be prevented effectively.

Figure 7A:
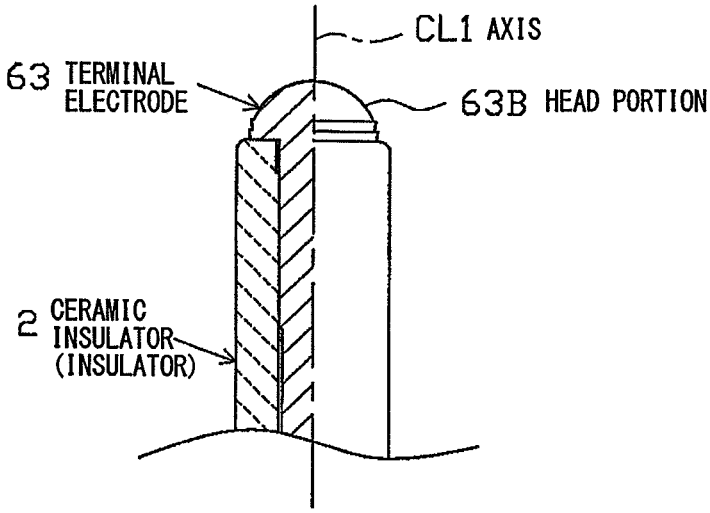
FIGS. 7(*a*) and 7(*b*) are partially cutaway, enlarged front views showing the head portions of the terminal electrodes in further embodiments of the present invention.
Figure 7B:
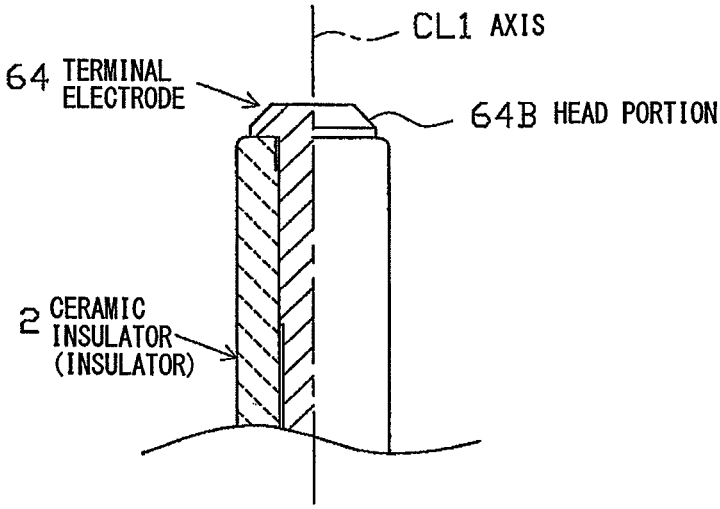

(b) In the above embodiment, as viewed on a section taken along the axis CL1, the head portion 6B of the terminal electrode 6 has a rectangular shape. However, the shape of the head portion 6B of the terminal electrode 6 is not limited thereto. For example, as shown in FIG. 7(*a*), a terminal electrode 63 may be configured such that the rear end surface of a head portion 63B is curved. Alternatively, as shown in FIG. 7(*b*), a terminal electrode 64 may be configured such that a head portion 64B has a trapezoidal section.

(c) In the above embodiment, a metal material of chromium-molybdenum steel is used to form the terminal electrode 6. However, another electrically conductive metal material may be used to form the terminal electrode 6.

(d) Although not particularly mentioned in the description of the above embodiment, the rear trunk portion 10 may have concentric ridges and grooves (so-called corrugations). In this case, leakage of current (flashover) along the surface of the rear trunk portion 10 can be more reliably prevented. When the rear trunk portion 10 has various outside diameters along the axis CL1, as in the case of provision of corrugations, "the outside diameter D of the rear trunk portion 10" means the average of the outside diameters of the rear trunk portion 10.

(e) In the above embodiment, the noble metal tip 31 is provided at a front end portion of the center electrode 5. However, the noble metal tip 31 may be eliminated. In the case where the noble metal tip 31 is eliminated, the spark discharge gap 33 is formed between a front end portion of the center electrode 5 and a distal end portion of the ground electrode 27.

(f) In the above embodiment, the thread diameter of the threaded portion 15 is reduced to M12 or less. However, the thread diameter of the threaded portion 15 is not limited to M12 or less.

(g) In the above embodiment, the tool engagement portion 19 has a hexagonal cross section. However, the shape of the tool engagement portion 19 is not limited thereto. For example, the tool engagement portion 19 may have a Bi-HEX (modified dodecagonal) shape [ISO22977:2005(E)] or the like.

The invention claimed is:

1. A spark plug comprising:

an insulator having an axial bore extending in a direction of an axis, and a terminal electrode having a rodlike leg portion inserted into a rear end portion of the axial bore and a head portion exposed at a rear end of the insulator, a front end subportion of the leg portion being fixed to the insulator, and the leg portion having a length of 35 mm or more along the axis, the spark plug being characterized in that the center of gravity of the terminal electrode is located inside the insulator, and wherein the terminal electrode has its center of gravity located 5 mm or more frontward from the rear end of the insulator as measured along the axis.

2. A spark plug comprising:

an insulator having an axial bore extending in a direction of an axis, and a terminal electrode having a rodlike leg portion inserted into a rear end portion of the axial bore and a head portion exposed at a rear end of the insulator, a front end subportion of the leg portion being fixed to the insulator, and the leg portion having a length of 35 mm or more along the axis, the spark plug being characterized in that the center of gravity of the terminal electrode is located inside the insulator, and wherein:

the insulator has a rear trunk portion located at the rear end side of the insulator and having an outside diameter of 9 mm or less, and the head portion has a weight of 0.8 g or less.

3. A spark plug comprising:

an insulator having an axial bore extending in a direction of an axis, and a terminal electrode having a rodlike leg portion inserted into a rear end portion of the axial bore and a head portion exposed at a rear end of the insulator, a front end subportion of the leg portion being fixed to the insulator, and the leg portion having a length of 35 mm or more along the axis, the spark plug being characterized in that the center of gravity of the terminal electrode is located inside the insulator, and wherein:

the insulator has a rear trunk portion located at the rear end side of the insulator and having an outside diameter of 9 mm or less, and the head portion has a length of 5 mm or less along the axis.

4. A spark plug as defined in claim 1, 2 or 3, wherein the terminal electrode has a Vickers hardness of 150 Hv or greater.

5. A spark plug as defined in claim 1, 2 or 3, wherein the head portion of the terminal electrode has a protrusion extending rearward with respect to the direction of the axis.

* * * * *